US011008667B2

(12) United States Patent
Kawami et al.

(10) Patent No.: US 11,008,667 B2
(45) Date of Patent: May 18, 2021

(54) LOW-GLOSS CHEMICALLY COLORED STAINLESS STEEL, CHEMICALLY COLORED STAINLESS STEEL PROCESSED PRODUCT, AND METHOD FOR MANUFACTURING SAME

(71) Applicant: Asahimekki Corporation, Tottori (JP)

(72) Inventors: Kazuyoshi Kawami, Tottori (JP); Atsushi Kinoshita, Tottori (JP); Tomoyuki Fukuta, Tottori (JP); Yasunobu Sawada, Tottori (JP)

(73) Assignee: ASAHIMEKKI CORPORATION

( * ) Notice: Subject to any disclaimer, the term of this patent is extended or adjusted under 35 U.S.C. 154(b) by 259 days.

(21) Appl. No.: 16/301,623

(22) PCT Filed: Aug. 2, 2017

(86) PCT No.: PCT/JP2017/028033
§ 371 (c)(1),
(2) Date: Nov. 14, 2018

(87) PCT Pub. No.: WO2018/047527
PCT Pub. Date: Mar. 15, 2018

(65) Prior Publication Data

US 2019/0292677 A1 Sep. 26, 2019

(30) Foreign Application Priority Data

Sep. 8, 2016 (JP) ..... JP2016-175143

(51) Int. Cl.
*C25D 11/38* (2006.01)
*C25F 3/16* (2006.01)
(Continued)

(52) U.S. Cl.
CPC ..... *C25D 11/38* (2013.01); *B24C 1/06* (2013.01); *B24C 11/00* (2013.01); *C23C 28/00* (2013.01);
(Continued)

(58) Field of Classification Search
None
See application file for complete search history.

(56) References Cited

U.S. PATENT DOCUMENTS 4,370,210 A * 1/1983 Yoshihara ..... C23C 22/77 118/665
9,429,380 B1 * 8/2016 Morrison ..... F41G 3/145
2015/0240377 A1 * 8/2015 Rubio ..... B21C 37/06 99/422

FOREIGN PATENT DOCUMENTS

CN 101059668 A 10/2007
CN 105296988 A 2/2016
(Continued)

OTHER PUBLICATIONS

Chinese Office Action re Application No. CN 201780031823.2, dated Mar. 31, 2020.
(Continued)

*Primary Examiner* — Adam Krupicka
(74) *Attorney, Agent, or Firm* — Husch Blackwell LLP

(57) ABSTRACT

[Problem] There is provided a colored stainless-steel product having excellent viewing-angle color tone discrimination and excellent corrosion resistance, in which a chemical coloration technique having sophisticated industrial color tone is used.

[Solution] The product is a chemically-colored stainless-steel product having an uneven surface formed by a grinding treatment, wherein the 60-degree specular gloss [Gs (60 degrees)] of the uneven surface is 5 to 50. The grinding treatment is performed by a single sandblasting treatment or
(Continued)

a combination of the sandblasting treatment and an electrolytic polishing treatment. The sandblasting treatment is performed with a projection material configured from inorganic particles having a Mohs' hardness of at least six. A manufacturing method includes a sandblasting treatment step, an electrolytic polishing treatment step, a coloration treatment step for dipping stainless steel in a coloration treatment solution including a mixed solution of a chromic acid and a sulfuric acid to generate a colored film thereon, and a curing treatment step for dipping the coloration-treated stainless steel in a curing treatment solution including a mixed solution of a chromic acid and a phosphoric acid to cure the colored film.

4 Claims, 2 Drawing Sheets

(51) Int. Cl.

| | |
|---|---|
| ***B24C 1/06*** | (2006.01) |
| ***C25D 11/36*** | (2006.01) |
| ***C25F 3/24*** | (2006.01) |
| ***B24C 11/00*** | (2006.01) |
| ***C23C 28/00*** | (2006.01) |

(52) U.S. Cl.
CPC ..... *C25D 11/36* (2013.01); *C25F 3/16* (2013.01); *C25F 3/24* (2013.01)

(56) References Cited

FOREIGN PATENT DOCUMENTS

| | | | |
|---|---|---|---|
| JP | 54-10245 | A | 1/1979 |
| JP | 56-112480 | A | 9/1981 |
| JP | 4-218695 | A | 8/1992 |
| JP | 7-252690 | A | 10/1995 |
| JP | 11-106986 | A | 4/1999 |
| JP | 2001-207607 | A | 8/2001 |
| JP | 2002-360989 | A | 12/2002 |
| JP | 2005-247629 | A | 9/2005 |

OTHER PUBLICATIONS

European Search Report re Application No. EP 17848472.1, dated Jan. 24, 2020.

* cited by examiner (a)

(b)

(c)

LOW-GLOSS CHEMICALLY COLORED STAINLESS STEEL, CHEMICALLY COLORED STAINLESS STEEL PROCESSED PRODUCT, AND METHOD FOR MANUFACTURING SAME

TECHNICAL FIELD

The present invention relates to chemically-colored stainless steel, a chemically-colored stainless-steel processed product, and a method for manufacturing the same, in which a gloss level is low and viewing angle dependence of the change in a color tone on a surface thereof is low, namely the variation in a color tone depending on a viewing angle is small (hereinafter, called "viewing-angle color tone discrimination is excellent"). In particular, the present invention relates to chemically-colored stainless steel, a chemically-colored stainless-steel processed product, and a method for manufacturing the same, in which a gloss level of a surface thereof is low and viewing-angle color tone discrimination is excellent by performing an uneven treatment on the surface by using grinding materials and performing a chemical coloration treatment on the surface.

BACKGROUND ART

Stainless steel is widely employed for an industrial product and a household product because of excellent corrosion resistance. However, because stainless steel has strong silver-white metallic luster, there is a problem that the design of a product using stainless steel has cool color tones and thus the stainless steel provides a sense of resistance for a user seeking warm color tones. For this reason, stainless steel colored with warm color tones is demanded.

A method of coloring stainless steel includes a method of performing oxidation coloring on stainless steel to generate a colored film and then performing an electrolytic treatment on the colored film to cure the film, and oxidation coloring performed by the INCO process using a chromic acid is widely employed (see Patent Document 1). However, because there is not technology sufficient to uniformly control the thickness of an oxide film having a coloring function, the method has a problem that color unevenness is easily generated.

As pretreatment for forming a low-frictional fluorine-resin coating film on the inner surface of a washing machine tub, there is disclosed a method for performing a blasting treatment on stainless steel materials by using #80 to #100 mesh alumina sand to enhance adhesion between the stainless steel materials and the coating film and make scratches occurring on the coating film be inconspicuous so as to keep the appearance (see Patent Document 2). However, this method relates to a surface treatment for enhancing coating-film adhesion, but does not relate to stainless steel on which a chemical coloration treatment is performed to lower a gloss level of a surface thereof and heighten viewing-angle color tone discrimination.

There is disclosed a manufacturing method of a surface-treated steel sheet of controlling a gloss level of a surface and a brightness of color of the surface-treated steel sheet by controlling operating conditions of acid cleaning such as an acid cleaning time, an acid component, an acid concentration, and an acid temperature (see Patent Document 3). However, this method corresponds to a chemical polishing treatment, a so-called wet etching treatment, but is not a method for utilizing a dry etching treatment such as a sandblasting treatment.

CITATION LIST

Patent Documents

Patent Document 1: Japanese Patent Application Laid-Open No. S54-10245

Patent Document 2: Japanese Patent Application Laid-Open No. 2002-360989

Patent Document 3: Japanese Patent Application Laid-Open No. H11-106986

SUMMARY OF THE INVENTION

Problems to be Solved by the Invention

The present invention is to propose chemically-colored stainless steel, a processed product, and a method for manufacturing the same using a chemical coloration technique, in which the surface of stainless steel does not have color unevenness, viewing-angle color tone discrimination is excellent, and industrial color tones are sophisticated.

Means for Solving the Problems

The problems of the present invention can be solved by the following aspects specifically.

(First Aspect)

Chemically-colored stainless steel having an uneven surface formed by a grinding treatment performed by a combination of a sandblasting treatment and an electrolytic polishing treatment, characterized in that a 60-degree specular gloss [Gs (60 degrees)] of the uneven surface is 5 to 50. This is because an area (e.g., 30 to 50) of which the 60-degree specular gloss [Gs (60 degrees)] of the uneven surface is intermediate can be realized with high precision by together using the sandblasting treatment and the electrolytic polishing treatment.

(Second Aspect)

A stainless-steel processed product using the chemically-colored stainless steel according to First Aspect. This has the effects that a stainless-steel processed product (e.g., chair, bathtub, toy) as well as the stainless steel have inconspicuous color unevenness and excellent viewing-angle color tone discrimination.

(Third Aspect)

A method of manufacturing chemically-colored stainless steel, the method comprising: a sandblasting treatment step of spraying a mixture of a grinding material and compressed air on a surface of stainless steel to form an uneven surface on the surface of stainless steel; an electrolytic polishing treatment step of electropolishing the sandblasted stainless steel; a coloration treatment step of dipping the electropolished stainless steel in a coloring treatment solution consisting of a mixed solution of a chromic acid and a sulfuric acid to generate a colored film; and a curing treatment step of dipping the coloration-treated stainless steel in a curing treatment solution consisting of a mixed solution of a chromic acid and a phosphoric acid to cure the colored film generated in the coloration treatment step. This is because chemically-colored stainless steel having an area (e.g., 30 to 50) of which the 60-degree specular gloss [Gs (60 degrees)] of the uneven surface is large can be realized with high precision by performing the electrolytic polishing treatment after the sandblasting treatment.

(Fourth Aspect)

A method of manufacturing a chemically-colored stainless-steel processed product using the method of manufacturing chemically-colored stainless steel according to Third Aspect. This is because a stainless-steel processed product (e.g., chair, bathtub, and toy) that has inconspicuous color unevenness and excellent viewing-angle color tone discrimination can be manufactured.

(Fifth Aspect)

Chemically-colored stainless steel having an uneven surface formed by a sandblasting treatment, characterized in that a 60-degree specular gloss [Gs (60 degrees)] of the uneven surface is 5 to 50 and a thickness of a colored film formed on the uneven surface at a coloration potential speed of 0.02 to 0.08 mV/sec is 90 nm to 220 nm. This is because stainless steel having the uneven surface formed by the sandblasting treatment has small specular reflection and chemically-colored stainless steel manufactured by performing the chemical coloration treatment on the stainless steel has inconspicuous color unevenness and excellent viewing-angle color tone discrimination. Moreover, the case where the 60-degree specular gloss [Gs (60 degrees)] is in a range of 5 to 50 has the effect that color unevenness is inconspicuous and viewing-angle color tone discrimination is excellent. Furthermore, this is because the development of the color tone is made gentle and thus color unevenness can be decreased by forming the colored film at the coloration potential speed of 0.02 to 0.08 mV/sec.

(Sixth Aspect)

A stainless-steel processed product using the chemically-colored stainless steel according to Fifth Aspect. This has the effects that a stainless-steel processed product (e.g., chair, bathtub, toy) as well as the stainless steel have inconspicuous color unevenness and excellent viewing-angle color tone discrimination.

(Seventh Aspect)

A method of manufacturing chemically-colored stainless steel, the method comprising: a sandblasting treatment step of spraying a mixture of a grinding material and compressed air on a surface of stainless steel to form an uneven surface on the surface of stainless steel; a coloration treatment step of dipping the sandblasted stainless steel in a coloring treatment solution consisting of a mixed solution of a chromic acid and a sulfuric acid to generate a colored film that is formed on the uneven surface at a coloration potential speed of 0.02 to 0.08 mV/sec and of which a thickness is 90 nm to 220 nm; and a curing treatment step of dipping the coloration-treated stainless steel in a curing treatment solution consisting of a mixed solution of a chromic acid and a phosphoric acid to cure the colored film generated in the coloration treatment step. This is because chemically-colored stainless steel by which the effect that color unevenness is inconspicuous and viewing-angle color tone discrimination is excellent is obtained can be realized by sequentially performing the sandblasting treatment and the chemical coloration treatment. Furthermore, this is because the development of the color tone is made gentle and thus color unevenness can be decreased by forming the colored film at the coloration potential speed of 0.02 to 0.08 mV/sec.

(Eighth Aspect)

A method of manufacturing a chemically-colored stainless-steel processed product using the method of manufacturing chemically-colored stainless steel according to Seventh Aspect. This is because a stainless-steel processed product (e.g., chair, bathtub, and toy) that has inconspicuous color unevenness and excellent viewing-angle color tone discrimination can be manufactured.

Advantageous Effect of the Invention

According to the present invention, colored stainless steel and a colored stainless-steel processed product (hereinafter, called "colored stainless-steel product") can be provided with high precision using a chemical coloration technique in which the 60-degree specular gloss [Gs (60 degrees)] of the surface is in the range of 5 to 50. As a result, it is possible to realize a colored stainless-steel product in which color unevenness does not appear, viewing-angle color tone discrimination is excellent, and industrial color tones are sophisticated.

MODE FOR CARRYING OUT THE INVENTION

Figure 1:
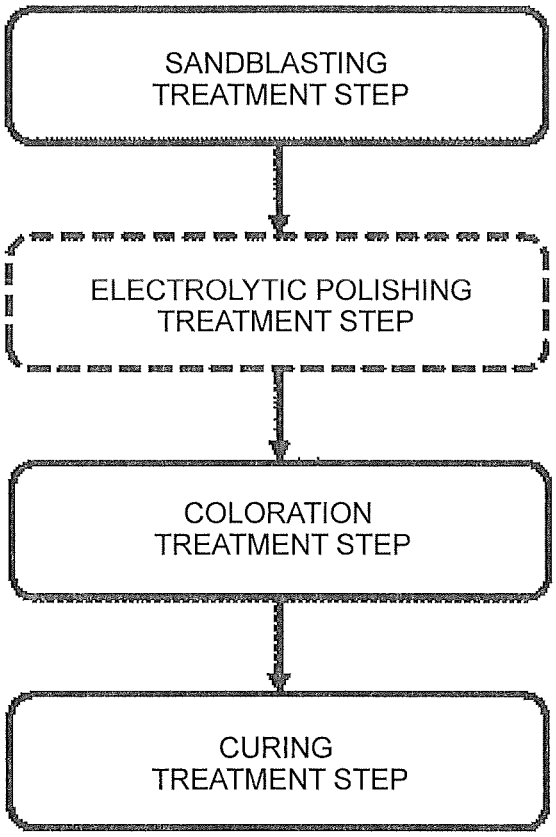
FIG. 1 is a process chart illustrating a flow of steps that constitute a manufacturing method of a colored stainless-steel product according to the present invention.

A colored stainless-steel product according to the present invention is characterized in that the 60-degree specular gloss [Gs (60 degrees)] of its surface is low to be 5 to 50 and the product has inconspicuous color unevenness and excellent viewing-angle color tone discrimination. As illustrated in FIG. 1, the colored stainless-steel product according to the present invention can be manufactured by way of "a sandblasting treatment step and an electrolytic polishing treatment step" for forming unevenness on the surface of stainless steel and "a coloration treatment step and a curing treatment step" for forming a chemically-colored film on the surface of stainless steel in order to develop the 60-degree specular gloss [Gs (60 degrees)] of the surface of stainless steel to be 5 to 50. In this regard, however, the electrolytic polishing treatment step is a step to be employed to produce an area (e.g., 30 to 50) of which the 60-degree specular gloss [Gs (60 degrees)] of the surface is intermediate, and thus the unevenness can be formed on the surface of stainless steel by using only the sandblasting treatment.

Hereinafter, explanations for the present invention will be made in order of "a metallic material and a processed product of the metallic material" that are processing targets, and "a sandblasting treatment step, an electrolytic polishing treatment step, a coloration treatment step, and a curing treatment step" that are a processing method, and then explanation will be made about an evaluation method. In addition, the present invention is not limited to the following aspects for realizing the invention.

(1) Metallic Material

Metallic materials to be used for the present invention are not limited to stainless materials such as austenitic stainless steel and ferritic stainless steel if the metallic materials can be subjected to surface unevenness processing by using a sandblasting treatment and an electrolytic polishing treatment and can be also subjected to a chemical coloration treatment. More specifically, the metallic materials include aluminum, aluminum alloy, iron, iron alloy, stainless steel, nickel, nickel alloy, titanium, titanium alloy, magnesium, magnesium alloy, tungsten, tungsten alloy, molybdenum, molybdenum alloy, zinc, zinc alloy, and the like, and may further include the well-known metal materials.

Aluminum and aluminum alloy can use, for example, a material that includes Al of 40% by mass or more, Al of 80% by mass or more, or Al of 99% by mass or more. For example, aluminum and aluminum alloy standardized by JIS H4000 to JIS H4180, JIS H5202, JIS H5303, or JIS Z3232 to JIS Z3263 can be used. For example, it is possible to use aluminum or aluminum alloy etc. of Al of 99.00% by mass or more, which is represented by alloy numbers 1085, 1080, 1070, 1050, 1100, 1200, 1N00, and 1N30 of aluminum standardized by JIS H4000.

Iron alloy can use, for example, stainless steel, mild steel, carbon steel, iron-nickel alloy, steel, or the like. For example, it is possible to use iron or iron alloy described in JIS G3101 to JIS G7603, JIS C2502 to JIS C8380, JIS A5504 to JIS A6514, or JIS E1101 to JIS E5402-1.

Stainless steel can use SUS 301, SUS 304, SUS 310, SUS 316, SUS 430, SUS 631 (Japanese Industrial Standards), or the like. Mild steel can use mild steel of carbon of 0.15% by mass or less, and can use mild steel etc. as described in JIS G3141. Iron-nickel alloy includes Ni of 35-85% by mass, and further includes the remainder consisting of Fe and inevitable impurities. More specifically, iron-nickel alloy can use iron-nickel alloy etc. as described in JIS C2531.

Nickel and nickel alloy can use, for example, a material that includes Ni of 40% by mass or more, Ni of 80% by mass or more, or Ni of 99.0% by mass or more. For example, it is possible to use nickel or nickel alloy standardized by JIS H4541 to JIS H4554, JIS H5701, or JIS G7604 to JIS G7605, JIS C2531. Moreover, for example, it is possible to use nickel or nickel alloy etc. of Ni of 99.0% by mass or more, which is represented by alloy numbers NW2200 and NW2201 as described in JIS H4551.

Titanium and titanium alloy can use, for example, a material that includes Ti of 40% by mass or more, Ti of 80% by mass or more, or Ti of 99.0% by mass or more. For example, it is possible to use titanium and titanium alloy standardized by JIS H4600 to JIS H4675 and JIS H5801.

Magnesium and magnesium alloy can use, for example, a material that includes Mg of 40% by mass or more, Mg of 80% by mass or more, or Mg of 99.0% by mass or more. For example, it is possible to use magnesium and magnesium alloy standardized by JIS H4201 to JIS H4204, JIS H5203 to JIS H5303, and JIS H6125.

Tungsten and tungsten alloy can use, for example, a material that includes tungsten of 40% by mass or more, tungsten of 80% by mass or more, or tungsten of 99.0% by mass or more. For example, it is possible to use tungsten and tungsten alloy standardized by JIS H4463.

Molybdenum and molybdenum alloy can use, for example, a material that includes Mo of 40% by mass or more, Mo of 80% by mass or more, or Mo of 99.0% by mass or more.

(2) Processed Product of Metallic Material

The processed product of metallic material according to the present invention is not particularly limited if the processed product is an article having excellent appearance by performing a chemical coloration treatment, namely, an article having excellent design. More specifically, the processed product includes panel, toy, bathtub, vat, chair, desk, thermos, body of vehicle, frame of bicycle, frame of the wheelchair, and the like. The present processed product may be any of: a product obtained by processing a metallic material on which a chemical coloration treatment is performed; and a product obtained by performing a chemical coloration treatment on a metallic material on which processing is performed.

(3) Sandblasting Treatment

A sandblasting treatment is a treatment of making a projection material (may be referred to as grinding material or polishing material) collide against a workpiece to perform a surface treatment on the workpiece. The projection method of the projection material includes a mechanical method, a pneumatic method, and a wet method. The pneumatic method includes a vacuum method of conveying a projection material by using negative pressure and a direct-pressure method of conveying a projection material by using positive pressure.

In the sandblasting treatment step, a projection material to be used in the present step to efficiently process the surface of metallic material preferably uses inorganic material having a higher hardness (e.g., Mohs' hardness of six or more, more preferably eight or more) than the metallic material, more preferably uses particles having a spherical shape or an angular shape such as a polygon, and still more preferably uses particles having an angular shape. As a specific example, the projection material includes glass beads, zirconia particles, a steel grid, alumina particles, silica particles, silicon carbide particles, and the like.

The granularity (count) of the projection material is preferably #70 to #800 and is more preferably #90 to #500. Particles having granularity smaller than #70 have tendencies to have a large particle diameter, the high haze of the treated product, and the decreased visibility. Because particles having granularity larger than #800 have a small particle diameter, the sandblasting treatment is easy to be inefficient.

A projection pressure when a projection material is projected on a metallic material is preferably 0.05 to 1 MPa and is more preferably 0.1 to 0.5 MPa. Because the projection pressure is low when the projection pressure is less than 0.05 MPa, a sandblasting step is performed inefficiently and an uneven surface with variation is easy to be formed. When the projection pressure exceeds 1 MPa, collision energy when the projection material arrives at the surface of metallic material is easy to increase, the unevenness of the treated surface has a larger shape, and the surface of metallic material on which a chemical coloration treatment is performed has inferior color tones.

A projection angle when a projection material is projected on a metallic material is preferably 10 to 90 degrees assuming that the surface of metallic material is zero degrees. This is because the sandblasting step is easy to be inefficient when the projection angle is less than 10 degrees. Considering efficiency, the projection angle is preferably 15 degrees or more, and is more preferably 20 degrees or more.

A projection distance (distance from a projection start position to the surface of metal material plate) when a projection material is projected on the surface of metallic material is preferably 5 to 300 mm and is more preferably 10 to 250 mm. When the projection distance is less than 1 mm, collision energy increases, the haze of the treated surface of metallic material becomes higher, and visibility decreases. When the projection distance exceeds 400 mm, the sandblasting treatment is easy to be inefficient.

A projection amount when a projection material is projected on the surface of metallic material is preferably 50 to 300 g/min, and is more preferably 100 to 200 g/min. When the projection amount is less than 50 g/min, the sandblasting treatment is easy to be inefficient. When the projection amount exceeds 300 g/min, the unevenness of the treated product that can be visually confirmed is easy to occur.

(4) Electrolytic Polishing Treatment

Electrolytic polishing is a polishing method of flowing a direct current by using metal as plus in an electrolytic polishing solution according to the metal to smooth and gloss a metallic surface by dissolving the convex portion of the finely uneven metallic surface. It is possible to remove a stain, a foreign material, and an affected layer generated by physical polishing such as buffing.

It is preferable that the kind of the electrolytic polishing solution is one or a mixed acidic aqueous solution of hydrogen peroxide water, glacial butyric acid, phosphoric acid, sulfuric acid, nitric acid, chromic acid, dichromate acid soda, and the like. Ethylene glycol monoethyl ether, ethylene glycol monobutyl ester, and glycerine can be used as the other addition agents. These addition agents stabilize an electrolytic solution and has an effect that an appropriate electrolytic range is broadened with respect to a concentration change, a time-dependent change, and a deterioration due to use.

More specifically, electrolytic polishing can be performed under conditions of 40 to 70 degrees Celsius, 3 to 10 minutes, and a direct current (10 to 30V, 3 to 60 A/dm$^3$) in an electrolytic solution consisting of phosphoric acid of 40 to 80% by volume, sulfuric acid of 5 to 30% by volume, water of 15 to 20% by volume, and ethylene glycol of 0 to 35% by volume.

(5) Coloration Treatment

An ultrathin optically-transparent oxide film (hereinafter, called "colored film") is formed, by a coloration treatment, on the surface of metallic material on which the sandblasting treatment and the electrolytic polishing treatment are performed. The metallic material is colored by using an interferential action of light caused by the colored film. It is possible to produce tasteful color tones on which the beauty of the base surface of metallic material is reflected. Hereinafter, stainless steel will be described as a specific example.

(5-1) Coloration Treatment

A so-called INCO process for performing electrolysis by a direct current by using stainless steel as an anode in a mixed solution (hereinafter, called "coloration solution") of a sulfuric acid and a chromic acid to generate a desired colored film depending on a potential difference between the anode and a reference electrode dipped in the aqueous solution is employed as a coloration method (see Japanese Patent Application Laid-Open No. S48-011243).

When optically calculating the thickness of a colored film from an interference peak of light, the thickness of the colored film generated on the surface of stainless steel is proportional to a potential difference (hereinafter, called "coloration potential") between the anode and the reference electrode. In regard to respective color tones, the values are 6 mV (blue: 90 nm), 13 mV (gold: 150 nm), 16 mV (red: 180 nm), and 19.5 mV (green: 220 nm) (see Journal of The Surface Finishing Society of Japan, Takeshi Takeuchi, Volume 33, Issue 11, 1986). The thickness of the colored film is meaningfully large compared to the thickness (1 nm to 3 nm) of a passive film generated on stainless steel.

Therefore, because color unevenness occurring on the colored stainless steel is caused by the variation of the thickness of the colored film, it is important to control the thickness of the colored film.

(5-2) Colored Film

Color unevenness can be reduced by lowering the generation speed of a colored film to mildly develop color tones. This is because the thickness of the colored film generated on the surface of stainless steel correlates with a coloration potential.

It is preferable that a mixture ratio (chromic acid/sulfuric acid) of a sulfuric acid and a chromic acid in the coloration solution is sulfuric acid of 40 to 50 wt/vol % with respect to chromic acid of 15 to 30 wt/vol %. This is because the generation speed of a colored film can be lowered and thus the generated thickness of the colored film can be precisely controlled by reducing a chromic acid concentration.

The generation speed of the colored film can be controlled by a coloration potential speed (mV/sec). The coloration potential speed is 0.02 to 0.08 mV/sec and is preferably 0.050 to 0.065 mV/sec. This is because the generation of the colored film is delayed and thus productivity decreases when the coloration potential speed is less than 0.02 mV/sec. This is because the thickness of the generated colored film becomes ununiform and thus uncomfortable feeling of color tone and color unevenness are generated when the coloration potential speed exceeds 0.08 mV/sec.

(5-3) Manganese Ion

A manganese ion (Mn2+) can be added to supplement the generation speed of a colored film accompanied with the reduction of a chromic acid concentration in a coloration solution. A manganese salt used for the coloration solution includes manganese chloride (MnCl2), manganese sulfate (MnSO4), manganese nitrate (Mn(NO3)2), and the like. One or two or more of them can be used. The concentration of a manganese ion (Mn2+) in the coloration solution is preferably 0.5 to 300 mmol/L, and is more preferably 5 to 150 mmol/L. When the concentration of the manganese ion (Mn2+) is less than 0.5 mmol/L, the generation of the colored film is not promoted. When the concentration of the manganese ion (Mn2+) exceeds 300 mmol/L, an indissoluble portion remains and has an influence on the generation of the colored film.

(6) Curing Treatment

This is to perform an electrolytic treatment on stainless steel on which a colored film is formed by oxidation coloring to cure the colored film. This curing treatment cures a colored film by embedding chromium in the porous portion of the colored film by an electrolysis action in a mixed solution of a phosphoric acid and the chromic acid (the curing treatment is performed to produce various color tones having metallic luster on the surface of stainless steel).

(7) Evaluation

The exterior appearance of the colored stainless-steel product has been evaluated by "color tone", "viewing-angle color tone discrimination", and "60-degree specular gloss [Gs (60 degrees)]". In addition, color tones have been evaluated based on "visual recognition" and L*, a*, b* color coordinate system (JIS Z8781-4: 2013) (hereinafter, called "CIELAB") determined by CIE (the International Commission on Illumination) in 1976. Hereinafter, it will be described in detail.

(7-1) Color-Tone Evaluation

Color discrimination has been visually performed on a test product (see FIG. 2, hereinafter, called "the present test product") of the colored stainless-steel product, and CIELAB has been measured by a spectrophotometer (CM-2600d made by Konica Minolta).

Herein, CIELAB is substantially complete color space and is devised by The International Commission on Illumination (CIE). CIELAB can describe all colors seen by a human eye, and can be used as the reference of a device-specific model. Three coordinates of CIELAB correspond to brightness of color (Black for L*=0 and diffuse color of White for L*=100), position between Red/Magenta and Green (a*<0 close to Green and a*>0 close to Magenta), and position between Yellow and Blue (b*<0 close to Blue and b*>0 close to Yellow).

(7-2) Viewing-Angle Color Tone Discrimination

The presence or absence of the color-tone change in the present test product when setting a sight line at a position obtained by shifting the sight line 60 degrees from a vertical direction with respect to the present test product placed horizontally (when seeing the test product at an angle of depression of 30 degrees) has been evaluated about the present test product. A case without the change in color tone has been determined as "○" as illustrated in (a) and (b) in FIG. 2, and a case with the change in color tone has been determined as "X" as illustrated in (c) in FIG. 2.

(7-3) 60-Degree Specular Gloss (Gs60°)

A 60-degree specular gloss method (Gs60°) has been used to express the mirror state of the surface of the present test product as numeric values. The measuring method of a 60-degree specular gloss is described in JIS Z8741 "specular gloss-measuring method". A gloss level of the surface of the colored stainless-steel product has been measured based on this description. A gloss meter (Gloss Meter U made by Toyo Seiki Manufacturing Co.) has been used as a measuring device.

EXAMPLES

Next, embodiments that create effects according to the present invention are described as Examples. Moreover, they are collectively indicated with Table 1.

TABLE 1

| | | Sandblasting treatment | | | | Coloration treatment | |
|---|---|---|---|---|---|---|---|
| | Granularity (#) | Projection amount (g/min) | Projection pressure (MPa) | Projection time (sec) | Electrolytic polishing treatment | Chromic acid/ Sulfuric acid (*1) | Coloration potential (mV) |
| Example 1 | 500 | 150 | 0.3 | 15 | Without | 25/50 | 15 |
| Example 2 | 500 | 300 | 0.3 | 15 | Without | 25/50 | 15 |
| Example 3 | 500 | 450 | 0.3 | 15 | Without | 25/50 | 15 |
| Example 4 | 500 | 600 | 0.3 | 15 | Without | 25/50 | 15 |
| Example 5 | 500 | 750 | 0.3 | 15 | Without | 25/50 | 15 |
| Example 6 | 500 | 900 | 0.3 | 15 | Without | 25/50 | 15 |
| Example 7 | 220 | 150 | 0.3 | 15 | Without | 25/50 | 15 |
| Example 8 | 220 | 300 | 0.3 | 15 | Without | 25/50 | 15 |
| Example 9 | 220 | 450 | 0.3 | 15 | Without | 25/50 | 15 |
| Example 10 | 220 | 600 | 0.3 | 15 | Without | 25/50 | 15 |
| Example 11 | 220 | 750 | 0.3 | 15 | Without | 25/50 | 15 |
| Example 12 | 220 | 900 | 0.3 | 15 | Without | 25/50 | 15 |
| Example 13 | 90 | 150 | 0.3 | 15 | Without | 25/50 | 15 |
| Example 14 | 90 | 300 | 0.3 | 15 | Without | 25/50 | 15 |
| Example 15 | 90 | 450 | 0.3 | 15 | Without | 25/50 | 15 |
| Example 16 | 90 | 600 | 0.3 | 15 | Without | 25/50 | 15 |
| Example 17 | 90 | 900 | 0.3 | 15 | Without | 25/50 | 15 |
| Example 18 | 90 | 750 | 0.3 | 15 | Without | 25/50 | 15 |
| Example 19 | 90 | 750 | 0.3 | 30 | Without | 25/50 | 15 |
| Example 20 | 90 | 750 | 0.3 | 40 | Without | 25/50 | 15 |
| Example 21 | 90 | 750 | 0.3 | 50 | Without | 25/50 | 15 |
| Example 22 | 90 | 750 | 0.3 | 60 | Without | 25/50 | 15 |
| Example 23 | 90 | 300 | 0.3 | 15 | Without | 25/50 | 9 |
| Example 24 | 90 | 300 | 0.3 | 15 | Without | 25/50 | 15 |
| Example 25 | 90 | 300 | 0.3 | 15 | Without | 25/50 | 18 |
| Example 26 | 220 | 300 | 0.3 | 15 | Without | 25/50 | 9 |
| Example 27 | 220 | 300 | 0.3 | 15 | Without | 25/50 | 15 |
| Example 28 | 220 | 300 | 0.3 | 15 | Without | 25/50 | 18 |
| Example 29 | 500 | 300 | 0.3 | 15 | Without | 25/50 | 9 |
| Example 30 | 500 | 300 | 0.3 | 15 | Without | 25/50 | 15 |
| Example 31 | 500 | 300 | 0.3 | 15 | Without | 25/50 | 18 |
| Example 32 | 90 | 300 | 0.3 | 15 | With | 25/50 | 15 |
| Example 33 | 220 | 300 | 0.3 | 15 | With | 25/50 | 15 |
| Example 34 | 500 | 300 | 0.3 | 15 | With | 25/50 | 15 |
| Comparative Example 1 | — | — | — | — | With | 25/50 | 4 |
| Comparative Example 2 | — | — | — | — | With | 25/50 | 9 |
| Comparative Example 3 | — | — | — | — | With | 25/50 | 15 |
| Comparative Example 4 | — | — | — | — | With | 25/50 | 18 |
| Comparative Example 5 | — | — | — | — | With | 25/50 | 22 |

| | Curing treatment Chromic acid/ Phosphoric acid (*1) | Color tone | | | | Viewing-angle color tone discrimination | GS60° |
|---|---|---|---|---|---|---|---|
| | | Visual recognition | L* | a* | b* | | |
| Example 1 | 25/0.25 | Gold | 44.2 | 4.6 | 10.6 | ○ | 10.0 |
| Example 2 | 25/0.25 | Gold | 45.2 | 4.9 | 12.1 | ○ | 14.0 |

TABLE 1-continued

| | | | | | | | |
|---|---|---|---|---|---|---|---|
| Example 3 | 25/0.25 | Gold | 46.2 | 3.0 | 11.9 | ○ | 13.2 |
| Example 4 | 25/0.25 | Gold | 46.9 | 0.6 | 9.8 | ○ | 23.0 |
| Example 5 | 25/0.25 | Gold | 45.5 | 3.7 | 11.4 | ○ | 13.5 |
| Example 6 | 25/0.25 | Gold | 44.6 | 3.2 | 9.7 | ○ | 15.7 |
| Example 7 | 25/0.25 | Gold | 43.8 | 2.8 | 8.0 | ○ | 22.6 |
| Example 8 | 25/0.25 | Gold | 43.6 | 4.0 | 9.0 | ○ | 9.8 |
| Example 9 | 25/0.25 | Gold | 44.7 | 3.2 | 8.8 | ○ | 10.5 |
| Example 10 | 25/0.25 | Gold | 43.0 | 5.1 | 6.8 | ○ | 10.4 |
| Example 11 | 25/0.25 | Gold | 44.5 | 3.0 | 8.3 | ○ | 11.9 |
| Example 12 | 25/0.25 | Gold | 43.5 | 4.7 | 7.3 | ○ | 11.5 |
| Example 13 | 25/0.25 | Gold | 44.5 | 3.7 | 9.8 | ○ | 11.8 |
| Example 14 | 25/0.25 | Gold | 43.8 | 4.3 | 10.3 | ○ | 8.0 |
| Example 15 | 25/0.25 | Gold | 44.8 | 2.9 | 10.1 | ○ | 8.0 |
| Example 16 | 25/0.25 | Gold | 43.5 | 4.0 | 8.1 | ○ | 11.3 |
| Example 17 | 25/0.25 | Gold | 44.9 | 3.0 | 9.5 | ○ | 23.0 |
| Example 18 | 25/0.25 | Gold | 43.9 | 2.8 | 8.5 | ○ | 16.2 |
| Example 19 | 25/0.25 | Black | 41.0 | 1.1 | 0.9 | ○ | 11.5 |
| Example 20 | 25/0.25 | Black | 39.2 | 1.0 | 1.3 | ○ | 11.1 |
| Example 21 | 25/0.25 | Black | 39.6 | 1.0 | 0.9 | ○ | 10.5 |
| Example 22 | 25/0.25 | Black | 38.8 | 2.2 | 2.0 | ○ | 7.9 |
| Example 23 | 25/0.25 | Navy blue | 47.5 | −1.8 | 0.5 | ○ | 11.5 |
| Example 24 | 25/0.25 | Gold | 43.8 | 4.3 | 10.3 | ○ | 8.0 |
| Example 25 | 25/0.25 | Reddish purple | 37.4 | 4.9 | −3.7 | ○ | 10.0 |
| Example 26 | 25/0.25 | Navy blue | 46.4 | −2.2 | −2.3 | ○ | 12.0 |
| Example 27 | 25/0.25 | Gold | 43.6 | 4.0 | 9.0 | ○ | 9.8 |
| Example 28 | 25/0.25 | Reddish purple | 36.9 | 9.5 | −0.9 | ○ | 10.3 |
| Example 29 | 25/0.25 | Navy blue | 45.7 | −2.5 | −2.6 | ○ | 12.8 |
| Example 30 | 25/0.25 | Gold | 45.2 | 4.9 | 12.1 | ○ | 14.0 |
| Example 31 | 25/0.25 | Reddish purple | 38.0 | 9.6 | −0.9 | ○ | 11.2 |
| Example 32 | 25/0.25 | Gold | 50.4 | 5.4 | 20.7 | ○ | 30.4 |
| Example 33 | 25/0.25 | Gold | 52.1 | 4.0 | 22.7 | ○ | 37.6 |
| Example 34 | 25/0.25 | Gold | 54.1 | 3.3 | 25.5 | ○ | 42.7 |
| Comparative Example 1 | 25/0.25 | Brown | 41.3 | 4.5 | 5.3 | x | 100 |
| Comparative Example 2 | 25/0.25 | Blue | 42.5 | −6.1 | −8.6 | x | 100 |
| Comparative Example 3 | 25/0.25 | Gold | 43.9 | 14.8 | 24.4 | x | 100 |
| Comparative Example 4 | 25/0.25 | Reddish purple | 28.0 | 22.2 | −25.2 | x | 100 |
| Comparative Example 5 | 25/0.25 | Green | 52.8 | −10.1 | 29.3 | x | 100 |

(*1): Concentration of chromic acid, sulfuric acid, and phosphoric acid is wt/v %.

Examples 1 to 6

(1) Sandblasting Treatment

The sandblasting treatment has been performed on the principal surface of the present test plate under the conditions of a projection material: alumina particles (#500), a projection pressure: 0.3 MPa, a projection angle: 40 degrees, a projection time: 15 seconds, and a projection distance: 50 mm after putting a test piece (30×30×1 mmt) in a sandblasting apparatus (not illustrated). In Examples 1 to 6, sandblasted products 1 to 6 have been manufactured while stepwise changing projection amounts from 150 g/m to 900 g/m as indicated in Table 1.

(2) Coloration Treatment

The coloration treatment has been performed on the sandblasted products 1 to 6 on the following conditions to manufacture color-treated products 1 to 6.

[Coloration Treatment Conditions]

Coloring solution composition: chromium oxide 250 g/L and sulfuric acid 500 g/L

Treatment temperature: 80 degrees Celsius

Treatment time: 8 minutes

Coloration potential: 15 mV (3) Curing Treatment

The curing treatment has been performed on the color-treated products 1 to 6 on the following conditions to manufacture the present test products 1 to 6.

[Curing Treatment Conditions]

Curing solution composition: chromium oxide 250 g/L and phosphoric acid 2.5 g/L

Treatment temperature: 25 degrees Celsius

Treatment time: 10 minutes

Current density: 0.5 A/dm$^2$ (4) Color-Tone Evaluation

Color tones have been visually confirmed about the present test products 1 to 6. All the color tones were "gold". Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 1 to 6. The color-tone changes in all the present test products 1 to 6 did not occur nearly, and thus the viewing-angle color tone discrimination has been determined as "○".

Figure 2:
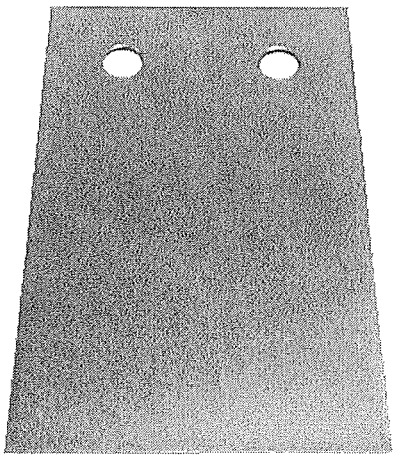
FIG. 2 is photographs obtained by comparing viewing-angle color tone discriminations depending on the treatment conditions of the colored stainless-steel product according to the present invention: (a) only sandblasting treatment; (b) treatment obtained by combining sandblasting treatment and electrolytic polishing treatment; and (c) only electrolytic polishing treatment.
Figure 2:
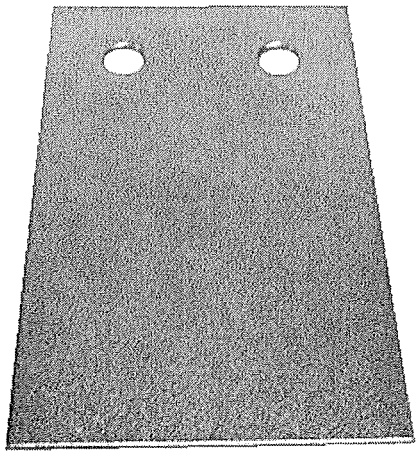
Figure 2:
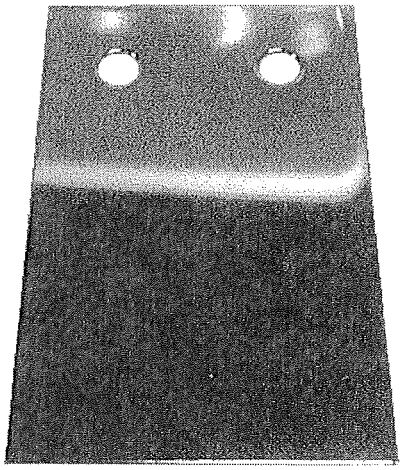

In addition, (a) in FIG. 2 illustrates the present test product 2 that is described in Example 2 according to the present invention.

(6) 60-Degree Specular Gloss (Gs60°) Evaluation

The 60-degree specular gloss (Gs60°) has been measured about the present test products 1 to 6 at an incidence angle of 60 degrees by using the gloss meter (Gloss Meter U made by Toyo Seiki Manufacturing Co.) based on JIS Z8741. The gloss levels were as indicated in Table 1.

Examples 7 to 12

(1) Sandblasting Treatment

The sandblasting treatment has been performed on the principal surface of the present test plate under the conditions of a projection material: alumina particles (#220), a projection pressure: 0.3 MPa, a projection angle: 40 degrees, a projection time: 15 seconds, and a projection distance: 50 mm after putting a test piece (30×30×1 mmt) in the sandblasting apparatus (not illustrated). In Examples 7 to 12, sandblasted products 7 to 12 have been manufactured while stepwise changing projection amounts from 150 g/m to 900 g/m as indicated in Table 1.

(2) Coloration Treatment

The coloration treatment has been performed on the sandblasted products 7 to 12 on the same conditions as Examples 1 to 6 to manufacture color-treated products 7 to 12.

(3) Curing Treatment

The curing treatment has been performed on the color-treated products 7 to 12 on the same conditions as Examples 1 to 6 to manufacture the present test products 7 to 12.

(4) Color-Tone Evaluation

Color tones have been visually confirmed about the present test products 7 to 12. All the color tones were "gold". Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 7 to 12. The color-tone changes in all the present test products 7 to 12 did not occur nearly, and thus the viewing-angle color tone discrimination has been determined as "○".

(6) 60-Degree Specular Gloss (Gs60°) Evaluation

The 60-degree specular gloss (Gs60°) has been measured about the present test products 7 to 12 at an incidence angle of 60 degrees by using the gloss meter (Gloss Meter U made by Toyo Seiki Manufacturing Co.) based on JIS Z8741. The gloss levels were as indicated in Table 1.

Examples 13 to 17

(1) Sandblasting Treatment

The sandblasting treatment has been performed on the principal surface of the present test plate under the conditions of a projection material: alumina particles (#90), a projection pressure: 0.3 MPa, a projection angle: 40 degrees, a projection time: 15 seconds, and a projection distance: 50 mm after putting a test piece (30×30×1 mmt) in the sandblasting apparatus (not illustrated). In Examples 13 to 17, sandblasted products 13 to 17 have been manufactured while stepwise changing projection amounts from 150 g/m to 900 g/m as indicated in Table 1.

(2) Coloration Treatment

The coloration treatment has been performed on the sandblasted products 13 to 17 on the same conditions as Examples 1 to 6 to manufacture color-treated products 13 to 17.

(3) Curing Treatment

The curing treatment has been performed on the color-treated products 13 to 17 on the same conditions as Examples 1 to 6 to manufacture the present test products 13 to 17.

(4) Color-Tone Evaluation

Color tones have been visually confirmed about the present test products 13 to 17. All the color tones were "gold". Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 13 to 17. The color-tone changes in all the present test products 13 to 17 did not occur nearly, and thus the viewing-angle color tone discrimination has been determined as "○".

(6) 60-Degree Specular Gloss (Gs60°) Evaluation

The 60-degree specular gloss (Gs60°) has been measured about the present test products 13 to 17 at an incidence angle of 60 degrees by using the gloss meter (Gloss Meter U made by Toyo Seiki Manufacturing Co.) based on JIS Z8741. The gloss levels were as indicated in Table 1.

Examples 18 to 22

(1) Sandblasting Treatment

The sandblasting treatment has been performed on the principal surface of the present test plate under the conditions of a projection material: alumina particles (#90), a projection pressure: 0.3 MPa, a projection angle: 40 degrees, a projection amount: 750 g/m, and a projection distance: 50 mm after putting a test piece (30×30×1 mmt) in the sandblasting apparatus (not illustrated). In Examples 18 to 22, sandblasted products 18 to 22 have been manufactured while stepwise changing projection times from 15 seconds to 60 seconds as indicated in Table 1.

(2) Coloration Treatment

The coloration treatment has been performed on the sandblasted products 18 to 22 on the same conditions as Examples 1 to 6 to manufacture color-treated products 18 to 22.

(3) Curing Treatment

The curing treatment has been performed on the color-treated products 18 to 22 on the same conditions as Examples 1 to 6 to manufacture the present test products 18 to 22.

(4) Color-tone Evaluation

Color tones have been visually confirmed about the present test products 18 to 22. The color tones were "gold" in Example 18 and "black" in Examples 19 to 22. Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 18 to 22. The color-tone changes in all the present test products 18 to 22 did not occur nearly, and thus the viewing-angle color tone discrimination has been determined as "○".

(6) 60-Degree Specular Gloss (Gs60°) Evaluation

The 60-degree specular gloss (Gs60°) has been measured about the present test products 18 to 22 at an incidence angle of 60 degrees by using the gloss meter (Gloss Meter U made by Toyo Seiki Manufacturing Co.) based on JIS Z8741. The gloss levels were as indicated in Table 1.

Examples 23 to 25

(1) Sandblasting Treatment

The sandblasting treatment has been performed on the principal surface of the present test plate under the same conditions as Example 14, namely, under conditions of a projection material: alumina particles (#90), a projection pressure: 0.3 MPa, a projection angle: 40 degrees, a projection amount: 300 g/m, a projection time: 15 seconds, and a projection distance: 50 mm after putting a test piece (30×30×1 mmt) in the sandblasting apparatus (not illustrated), and sandblasted products 23 to 25 have been manufactured.

(2) Coloration Treatment

The coloration treatment has been performed on the sandblasted products 23 to 25 on the following conditions while stepwise changing coloration potentials in order of 9 mV, 15 mV, and 18 mV to manufacture color-treated products 23 to 25.

[Coloration Treatment Condition]

Coloring solution composition: chromium oxide 250 g/L and sulfuric acid 500 g/L

Treatment temperature: 80 degrees Celsius

Treatment time: 8 minutes

Coloration potentials: 9 mV, 15 mV, and 18 mV (3) Curing Treatment

The curing treatment has been performed on the color-treated products 23 to 25 on the same conditions as Examples 1 to 6 to manufacture the present test products 23 to 25.

(4) Color-Tone Evaluation

Color tones have been visually confirmed about the present test products 23 to 25. The color tones were "navy blue" in Example 23, "gold" in Example 24, and "reddish purple" in Example 25. Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 23 to 25. The color-tone changes in all the present test products 23 to 25 did not occur nearly, and thus the viewing-angle color tone discrimination has been determined as "○".

(6) 60-Degree Specular Gloss (Gs60°) Evaluation

The 60-degree specular gloss (Gs60°) has been measured about the present test products 23 to 25 at an incidence angle of 60 degrees by using the gloss meter (Gloss Meter U made by Toyo Seiki Manufacturing Co.) based on JIS Z8741. The gloss levels were as indicated in Table 1.

Examples 26 to 28

(1) Sandblasting Treatment

The sandblasting treatment has been performed on the principal surface of the present test plate under the same conditions as Example 8, namely, under conditions of a projection material: alumina particles (#220), a projection pressure: 0.3 MPa, a projection angle: 40 degrees, a projection amount: 300 g/m, a projection time: 15 seconds, and a projection distance: 50 mm after putting a test piece (30×30×1 mmt) in the sandblasting apparatus (not illustrated), and sandblasted products 26 to 28 have been manufactured.

(2) Coloration Treatment

The coloration treatment has been performed on the sandblasted products 26 to 28 on the following conditions while stepwise changing coloration potentials in order of 9 mV, 15 mV, and 18 mV to manufacture color-treated products 26 to 28.

[Coloration Treatment Condition]

Coloring solution composition: chromium oxide 250 g/L and sulfuric acid 500 g/L

Treatment temperature: 80 degrees Celsius

Treatment time: 8 minutes

Coloration potentials: 9 mV, 15 mV, and 18 mV (3) Curing Treatment

The curing treatment has been performed on the color-treated products 26 to 28 on the same conditions as Examples 1 to 6 to manufacture the present test products 26 to 28.

(4) Color-Tone Evaluation

Color tones have been visually confirmed about the present test products 26 to 28. The color tones were "navy blue" in Example 26, "gold" in Example 27, and "reddish purple" in Example 28. Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 26 to 28. The color-tone changes in all the present test products 26 to 28 did not occur nearly, and thus the viewing-angle color tone discrimination has been determined as "○".

(6) 60-Degree Specular Gloss (Gs60°) Evaluation

The 60-degree specular gloss (Gs60°) has been measured about the present test products 26 to 28 at an incidence angle of 60 degrees by using the gloss meter (Gloss Meter U made by Toyo Seiki Manufacturing Co.) based on JIS Z8741. The gloss levels were as indicated in Table 1.

Examples 29 to 31

(1) Sandblasting Treatment

The sandblasting treatment has been performed on the principal surface of the present test plate under the same conditions as Example 2, namely, under conditions of a projection material: alumina particles (#500), a projection pressure: 0.3 MPa, a projection angle: 40 degrees, a projection amount: 300 g/m, a projection time: 15 seconds, and a projection distance: 50 mm after putting a test piece (30×30×1 mmt) in the sandblasting apparatus (not illustrated), and sandblasted products 29 to 31 have been performed.

(2) Coloration Treatment

The coloration treatment has been performed on the sandblasted products 29 to 31 on the following conditions while stepwise changing coloration potentials in order of 9 mV, 15 mV, and 18 mV to manufacture color-treated products 29 to 31.

[Coloration Treatment Condition]

Coloring solution composition: chromium oxide 250 g/L and sulfuric acid 500 g/L

Treatment temperature: 80 degrees Celsius

Treatment time: 8 minutes

Coloration potentials: 9 mV, 15 mV, and 18 mV (3) Curing Treatment

The curing treatment has been performed on the color-treated products 29 to 31 on the same conditions as Examples 1 to 6 to manufacture the present test products 29 to 31.

(4) Color-Tone Evaluation

Color tones have been visually confirmed about the present test products 29 to 31. The color tones were "navy blue" in Example 29, "gold" in Example 30, and "reddish purple" in Example 31. Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 29 to 31. The color-tone changes in all the present test products 29 to 31 did not occur nearly, and thus the viewing-angle color tone discrimination has been determined as "○".

(6) 60-Degree Specular Gloss (Gs60°) Evaluation

The 60-degree specular gloss (Gs60°) has been measured about the present test products 29 to 31 at an incidence angle of 60 degrees by using the gloss meter (Gloss Meter U made by Toyo Seiki Manufacturing Co.) based on JIS Z8741. The gloss levels were as indicated in Table 1.

Examples 32 to 34

(1) Sandblasting Treatment

The sandblasting treatment has been performed on the principal surface of the present test plate under the same conditions as Example 14, namely, under conditions of a projection material: alumina particles (#90), a projection pressure: 0.3 MPa, a projection angle: 40 degrees, a projection amount: 300 g/m, a projection time: 15 seconds, and a projection distance: 50 mm after putting a test piece (30×30×1 mmt) in the sandblasting apparatus (not illustrated), and a sandblasted product 32 has been manufactured. Next, a sandblasted product 33 has been manufactured under the same conditions as Example 8, namely, under the same conditions as Example 14 except for the change to a projection material: alumina particles (#220), and a sandblasted product 34 has been manufactured under the same conditions as Example 2, namely, under the same conditions as Example 14 except for the change to a projection material: alumina particles (#500).

(2) Electrolytic Polishing Treatment

The electrolytic polishing treatment has been performed on the sandblasted products 32 to 34 under the following conditions to manufacture electrolytic-polishing treated products 32 to 34.

[Electrolytic Polishing Treatment Condition]

Electrolytic polishing solution composition: phosphoric acid 70 ml/L, sulfuric acid 20 ml/L, and ethylene glycol 0.2 ml/L Treatment temperature: 70 degrees Celsius Treatment time: 5 minutes Current Density: 10 A/dm$^2$ (3) Coloration Treatment The coloration treatment has been performed on the electrolytic-polishing treated products 32 to 34 on the following conditions to manufacture color-treated products 32 to 34.

[Coloration Treatment Condition]

Coloring solution composition: chromium oxide 250 g/L and sulfuric acid 500 g/L

Treatment temperature: 80 degrees Celsius

Treatment time: 8 minutes

Coloration potential: 15 mV (3) Curing Treatment

The curing treatment has been performed on the color-treated products 32 to 34 on the same conditions as Examples 1 to 6 to manufacture the present test products 32 to 34.

(4) Color-Tone Evaluation

Color tones have been visually confirmed about the present test products 32 to 34. All the color tones were "gold". Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products 32 to 34. The color-tone changes in all the present test products 32 to 34 did not occur nearly, and thus the viewing-angle color tone discrimination has been determined as "○".

In addition, (b) in FIG. 2 illustrates the present test product 34 that is described in Example 34 according to the present invention.

(6) 60-Degree Specular Gloss (Gs60°) Evaluation

The 60-degree specular gloss (Gs60°) has been measured about the present test products 32 to 34 at an incidence angle of 60 degrees by using the gloss meter (Gloss Meter U made by Toyo Seiki Manufacturing Co.) based on JIS Z8741. The gloss levels were as indicated in Table 1.

Comparative Examples 1 to 5

In Comparative Example 1 to 5, the sandblasting treatment has not been performed, but only the electrolytic polishing treatment has been performed under the same conditions as Examples 32 to 34 to manufacture electrolytic-polishing treated products (comparative products 1 to 5).

(1) Coloration Treatment

The coloration treatment has been performed on the electrolytic-polishing treated products (comparative products 1 to 5) on the following conditions while stepwise changing coloration potentials in order of 4 mV, 9 mV, 15 mV, 18 mV, and 22 mV, and color-treated products (comparative products 1 to 5) have been performed.

[Coloration Treatment Condition]

Coloring solution composition: chromium oxide 250 g/L and sulfuric acid 500 g/L

Treatment temperature: 80 degrees Celsius

Treatment time: 8 minutes

Coloration potentials: 4 mV, 9 mV, 15 mV, 18 mV, and 22 mV (3) Curing Treatment

The curing treatment has been performed on the color-treated products (comparative products 1 to 5) on the same conditions as Examples 1 to 6 to manufacture the present test products (comparative products 1 to 5).

(4) Color-Tone Evaluation

Color tones have been visually confirmed about the present test products (comparative products 1 to 5). The color tones were "brown," "blue", "gold", "reddish purple", and "green" in sequence as indicated in Table 1. Furthermore, CIELAB has been measured by the spectrophotometer (CM-2600d made by Konica Minolta). CIELAB was as indicated in Table 1.

(5) Viewing-Angle Color-Tone Discrimination Evaluation

The presence or absence of the color-tone change in the present test products when setting a sight line at a position obtained by shifting the sight line 60 degrees from a vertical direction with respect to the present test products placed horizontally (when seeing the test products at an angle of depression of 30 degrees) has been evaluated about the present test products (comparative products 1 to 5). All the present test products (comparative products 1 to 5) have different color tones on upper and lower sides, and the viewing-angle color tone discrimination has been determined as "X". In addition, (c) in FIG. 2 illustrates the present test product (comparative product 3) that is described in Comparative Example 3. The change in color tone is recognized on the upper and lower sides.

(6) 60-Degree Specular Gloss (Gs60°) Evaluation

The 60-degree specular gloss (Gs60°) has been measured about the present test products (comparative products 1 to 5) at an incidence angle of 60 degrees by using a gloss meter (Gloss Meter U made by Toyo Seiki Manufacturing Co.) based on JIS Z8741. The gloss levels were as indicated in Table 1.

Overview (1) The colored stainless-steel products on which the sandblasting treatment of the present invention is performed show various kinds of color tones and have excellent viewing-angle color tone discrimination. Moreover, the 60-degree specular gloss (Gs60°) is in a range of 7.9 to 23 (Examples 1 to 22).

(2) The colored stainless-steel products on which the sandblasting treatment and the electrolytic polishing treatment of the present invention are together performed have the 60-degree specular gloss (Gs60°) of 30.2 to 42.7 and have a high gloss level compared to the colored stainless-steel products on which only the sandblasting treatment is performed. It is possible to heighten the 60-degree specular gloss (Gs60°) by using the electrolytic polishing treatment together. In addition, the colored stainless-steel products have excellent viewing-angle color tone discrimination (Examples 32 to 34).

(3) All of the colored stainless-steel products according to the present invention have excellent viewing-angle color tone discrimination (Examples 1 to 34 versus Comparative Examples 1 to 5).

INDUSTRIAL APPLICABILITY

According to the present invention, it is possible to provide colored stainless steel having excellent viewing-angle color tone discrimination and excellent corrosion resistance, in which a chemical coloration technique having sophisticated industrial color tone is used.

The invention claimed is:

1. Chemically-colored stainless steel having an uneven surface formed by a sandblasting treatment, characterized in that a 60-degree specular gloss [Gs (60 degrees)] of the uneven surface is 5 to 50 and a thickness of a colored film formed on the uneven surface at a coloration potential speed of 0.02 to 0.08 mV/sec is 90 nm to 220 nm.

2. A stainless-steel processed product using the chemically-colored stainless steel according to claim 1.

3. A method of manufacturing chemically-colored stainless steel, the method comprising:

a sandblasting treatment step of spraying a mixture of a grinding material and compressed air on a surface of stainless steel to form an uneven surface on the surface of stainless steel;

a coloration treatment step of dipping the sandblasted stainless steel in a coloring treatment solution consisting of a mixed solution of a chromic acid and a sulfuric acid to generate a colored film that is formed on the uneven surface at a coloration potential speed of 0.02 to 0.08 mV/sec and of which a thickness is 90 nm to 220 nm; and a curing treatment step of dipping the coloration-treated stainless steel in a curing treatment solution consisting of a mixed solution of a chromic acid and a phosphoric acid to cure the colored film generated in the coloration treatment step.

4. A method of manufacturing a chemically-colored stainless-steel processed product using the method of manufacturing chemically-colored stainless steel according to claim 3.

* * * * *